US006976801B2

(12) United States Patent
Salomon et al.

(10) Patent No.: US 6,976,801 B2
(45) Date of Patent: Dec. 20, 2005

(54) METHOD AND SYSTEM FOR TRANSPORTING MAILPIECES IN A PRINTING STATION

(75) Inventors: James A. Salomon, Cheshire, CT (US); Steven E. Cohen, South Windsor, CT (US); Cyndee Jonas, Painted Post, NY (US); Eric A. Belec, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 203 days.

(21) Appl. No.: 09/751,489

(22) Filed: Dec. 28, 2000

(65) Prior Publication Data

US 2002/0085871 A1 Jul. 4, 2002

(51) Int. Cl.[7] ..... B41J 13/08; B41J 13/12; B65H 5/02

(52) U.S. Cl. ..... 400/635; 271/7; 400/642; 347/104

(58) Field of Search ..... 400/635; 271/34, 271/35, 10.15, 4.06, 7, 10.1

(56) References Cited

U.S. PATENT DOCUMENTS 4,121,818 A * 10/1978 Riley et al. ..... 270/52.29
4,235,431 A * 11/1980 Abrams et al. ..... 271/10.03
4,361,086 A * 11/1982 Simonotti et al. ..... 101/93.18
4,675,498 A * 6/1987 Lemelson ..... 219/126.2
5,104,105 A * 4/1992 Cote et al. ..... 270/1.02
5,265,867 A * 11/1993 Magee ..... 271/272
5,429,249 A 7/1995 Belec et al. ..... 209/584
5,467,709 A 11/1995 Salomon ..... 101/93
5,467,973 A * 11/1995 Graushar et al. ..... 270/1.02
5,828,387 A * 10/1998 Wataya et al. ..... 347/14
5,923,343 A 7/1999 Brosseau et al. ..... 347/4
6,431,778 B1 * 8/2002 Coudray et al. ..... 271/275

* cited by examiner

*Primary Examiner*—Daniel J. Colilla
(74) *Attorney, Agent, or Firm*—Ronald Reichman; Angelo N. Chaclas

(57) ABSTRACT

The present invention describes a double belt transport system for moving a mailpiece into a printing area of a digital printer. The transport system includes an upper belt and a lower belt. The upper belt has a straight section to form a nip with the lower belt to ingest the mailpiece. The straight section also defines a registration plane to register the upper surface of the mailpiece with respect to the print head of the printer. In order to make sure the registration is consistent regardless of the thickness of the mailpiece, an up-lifting mechanism is used to push the bottom of the mailpiece in an upward direction against a shield plate, which is positioned substantially on the registration plane. A velocity measurement device, such as an optical encoder, is used to measure the moving speed of the belts so that the printing speed of the digital printer matches the moving speed of the mailpiece in the print area.

9 Claims, 6 Drawing Sheets

METHOD AND SYSTEM FOR TRANSPORTING MAILPIECES IN A PRINTING STATION

TECHNICAL FIELD

The present invention relates generally to a transport system that uses driving belts to move mailpieces and, more particularly, a transport system to move a mailpiece into a printing station to be printed with an indicia, address, advertisement slogan, or other image.

BACKGROUND OF THE INVENTION

Mailing machines utilizing an inkjet printer to print an indicia on a mailpiece are well known. Typically, an inkjet printer uses a print head consisting of one or more rows of nozzles to apply ink droplets over a printed area on the mailpiece surface. Because the printing must be completed over a period of time while the mailpiece moves past the nozzles, the printed image on the mailpiece could be distorted if the mailpiece is not moved in accordance with a specified speed or along a specified direction. Furthermore, the distance between the mailpiece surface to be printed and the nozzles must be appropriately spaced so as to avoid contact by the mailpiece surface with the nozzles.

For imaging, printers typically use rollers to move a substrate into the printing area while also limiting the gap to maintain image quality. These printers do not provide a mechanism to maintain the correct distance between the substrate surface and the print head for a wide range of substrate thickness. While those printers can be used to make print on regular paper stocks or postcards, they are not designed for printing mailpieces the thickness of which can vary considerably. Furthermore, in a printer that uses belt and rollers to ingest the mailpiece, the hard nip formed by the driven belt and rollers could cause the mailpiece to slow down relative to the transport belt when the mailpiece hits the hard nip. Moreover, if the mailpiece is guided by one or more nips formed by the driven belt and rollers, the motion of the mailpiece could be skewed such that the mailpiece may not travel along a specified direction through the printing area of the printer. The skewed motion of the mailpiece may distort a printed image printed by an inkjet printer or the like.

It is advantageous and desirable to provide a transport system to mailpieces in a printer for digital printing, wherein the aforementioned disadvantages can be eliminated.

SUMMARY OF THE INVENTION

The first aspect of the present invention is a double-belt transport system having an upstream end and a downstream end for moving a mailpiece from the upstream end into a printing area of a printer, wherein the mailpiece has a lower surface and an opposing upper surface to be printed by a print head located in the printing area. The transport system comprises:

an upper belt looping around an input pulley and an exit pulley to form a straight section covering the printing area and defining a registration plane of the print head;

a lower belt having an intake section running from the upstream end towards the downstream end, wherein the input pulley and the intake section form an ingest nip for providing a friction force to move the mailpiece from the upstream end into the printing area for printing.

Preferably, the double belt transport system further includes a shield plate having a reference surface facing the direction of the inkjet drop trajectory and located substantially in the registration plane in the printing area so as to allow the upper surface of the mailpiece to press against the reference surface of the shield plate for registration.

Preferably, the double belt transport system also includes a lifting mechanism located below the lower surface of the mailpiece for urging the mailpiece to register against the shield plate so that the upper surface of the mailpiece is kept in contact with the straight section while the mailpiece moves through the printing area.

Preferably, the double belt transport system also comprises a deck having an upstream section and a downstream section, wherein the upstream section is located adjacent to the ingest nip for supporting the mailpiece when the mailpiece moves towards the ingest nip.

Preferably, the double belt transport system further comprises a driving mechanism to drive both the upper looping belt and the lower looping belt in order to reduce shearing on the mailpiece.

Preferably, the double belt transport system also comprises a velocity measurement mechanism, such as an optical encoder, operatively connected to at least one of the looping belts to ensure that the printing speed of the print head is consistent with the moving speed of the mailpiece in the printing area.

The second aspect of the present invention is a method of moving a mailpiece from a downstream end towards an upstream end into a printing area having a length, wherein the mailpiece has a lower surface and an opposing upper surface to be printed by a print head in the printing area. The method comprises the steps of:

providing an upper belt having a straight section located between an input pulley and an exit pulley running the length of the printing area for defining a registration plane of the print head; and providing a lower belt having an intake section running from the upstream end towards the downstream end, wherein the intake section and the input pulley form an ingest nip to provide a friction force to move the mailpiece into the printing area for printing.

Preferably, the method also comprises the step of urging the mailpiece to move towards the upper belt so that the mailpiece surface is kept in contact with the straight section of the upper belt.

Preferably, the method further comprises the step of providing a shield plate having a reference surface facing the direction of the inkjet drop trajectory and located substantially on the registration plane in the printing area so as to allow the upper surface of the mailpiece to press against the reference surface of the shield plate for registration.

The third aspect of the present invention is a printer having an upstream end and a downstream end for printing on the upper surface of a mailpiece. The printer comprises a print head located above a printing area; and a double belt transport system for moving the mailpiece from the upstream end into the printing area, wherein the mailpiece has a lower surface opposing the upper surface, and wherein the double belt transport system comprises an upper looping belt having a straight section covering the printing area, wherein the straight section defines a registration plane regarding the print head; and a lower looping belt having a mailpiece intake section running from the upstream end towards the downstream end, wherein the mailpiece intake section and the straight section form an ingest nip for providing a friction force to move the mailpiece into the printing area for printing.

The present invention will become apparent upon reading the description taken in conjunction with FIGS. 1 to 5*d*.

DETAILED DESCRIPTION

Figure 1:
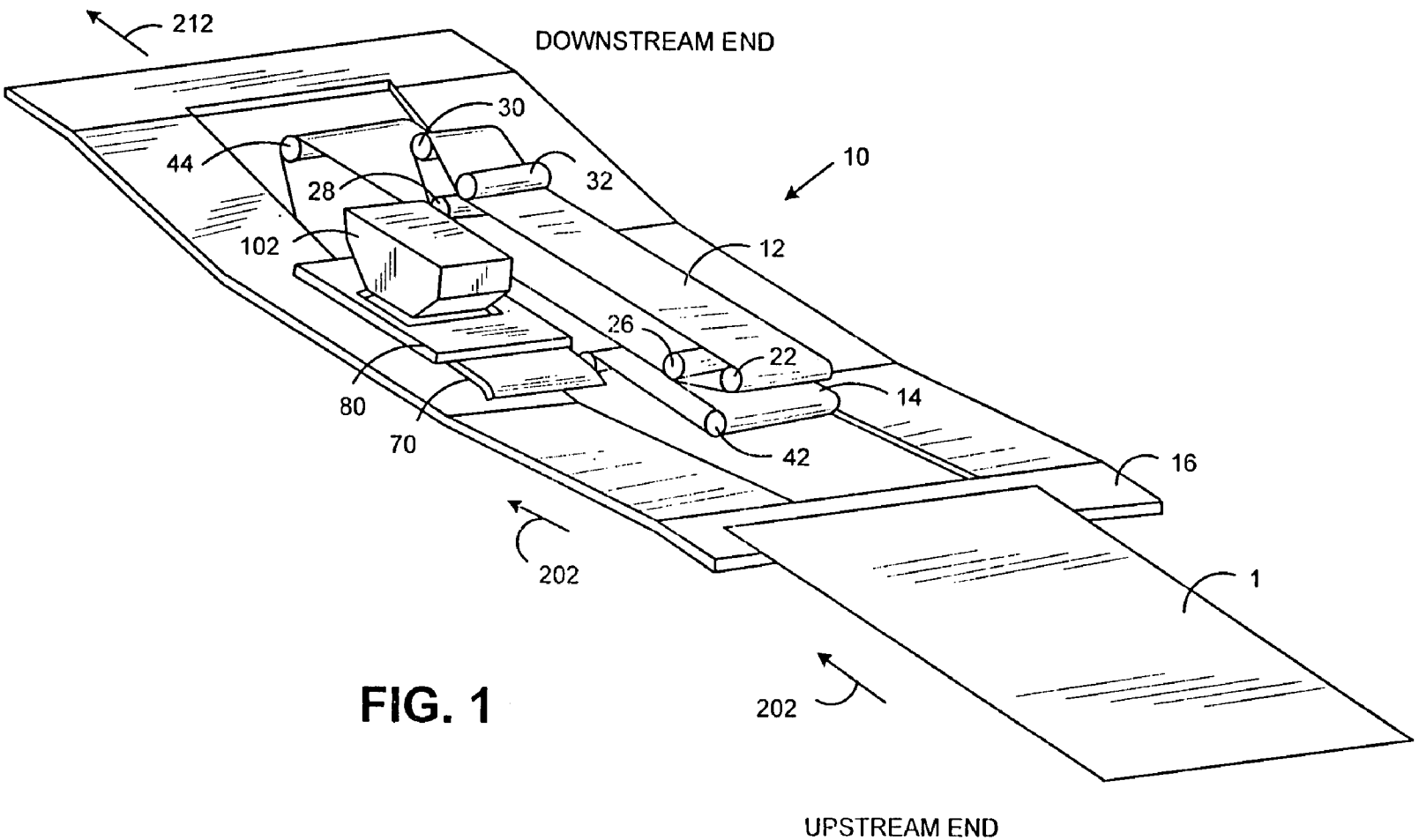
FIG. 1 is a diagrammatic representation illustrating the double belt transport system, according to the present invention.

FIG. 1 illustrates the double belt transport system 10 of the present invention. Preferably, the transport system 10 is used to move a mailpiece 1 in a digital printer which uses a print head 102, such as an inkjet print head or the like, to print text, graphics or an image on the mailpiece 1. As shown, the transport system 10 comprises an upper belt 12 and a lower belt 14 for transporting the mailpiece 1 from the upstream end along an input direction 202 to the downstream end along an exit direction 212. A deck 16 is used to support the mailpiece as the mailpiece enters and exits the transport system 10. A lifting mechanism 70 located below the print head 102 is used to urge the mailpiece 1 to move upwards toward the print head 102, while a shield plate 80, the lower surface of which defines a registration plane 110 (FIG. 3), allows the upper surface of the mailpiece 1 to press against the lower surface of the shield plate 80 for registering the mailpiece 1 relative to the print head 102. The registration plane 110 is separated from the print head 102 substantially by a fixed distance. For example, if the print head 102 includes one or more rows of inkjet nozzles to provide a plurality of ink droplets for printing, then the distance should be kept minimal to attain the best possible spatial resolution of the print head. However, the distance should also be kept far enough from the print head to avoid smearing of the ink droplets. This distance is seen as a gap between the print head 102 and the lower surface of the shield plate 80. This lower surface substantially coincides with the interface between the upper belt 12 and the lower belt 14, when the mailpiece 1 is not present at the interface, as shown in FIG. 2.

Figure 2:
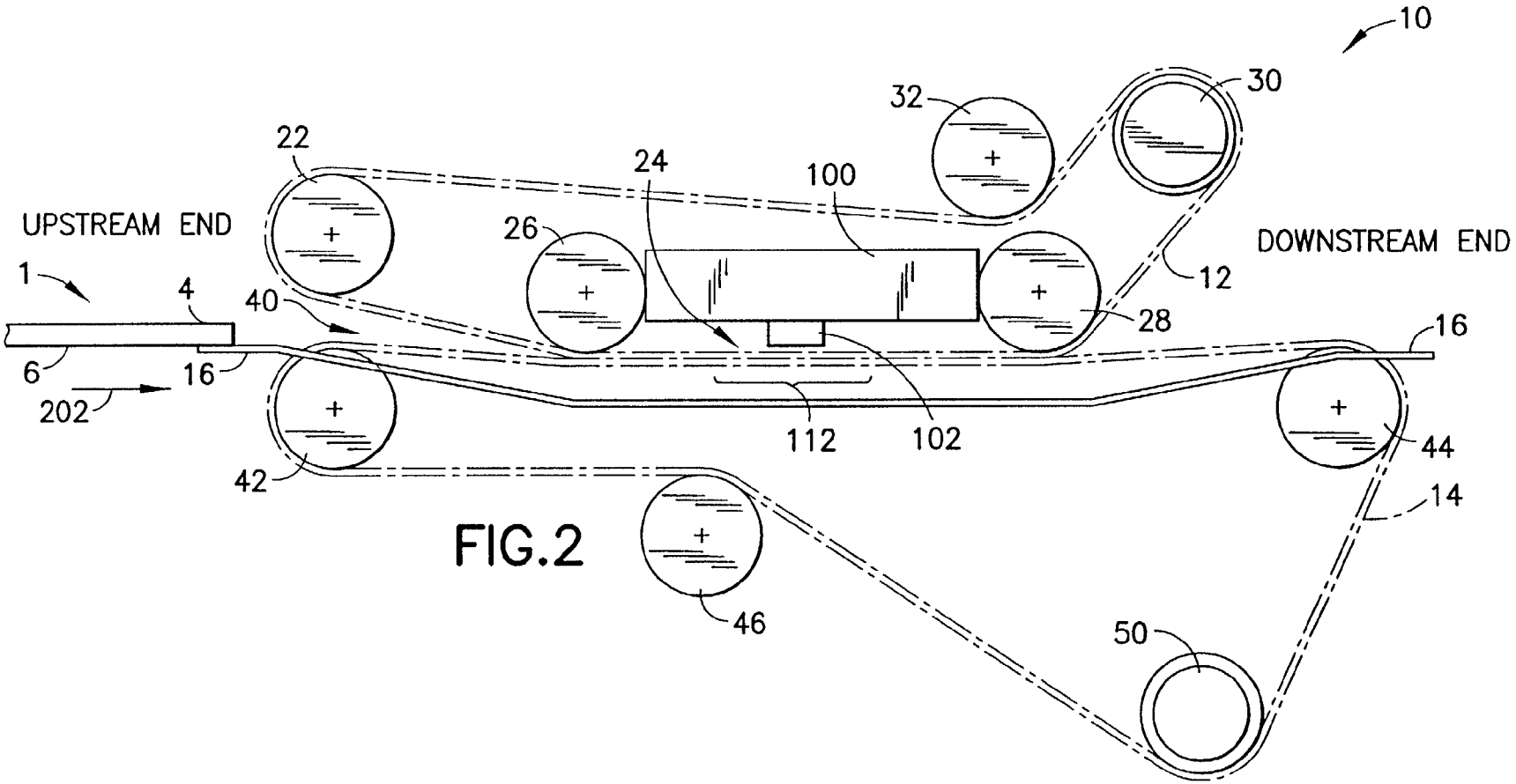
FIG. 2 is a diagrammatic representation illustrating the side view of the transport system.
Figure 3:
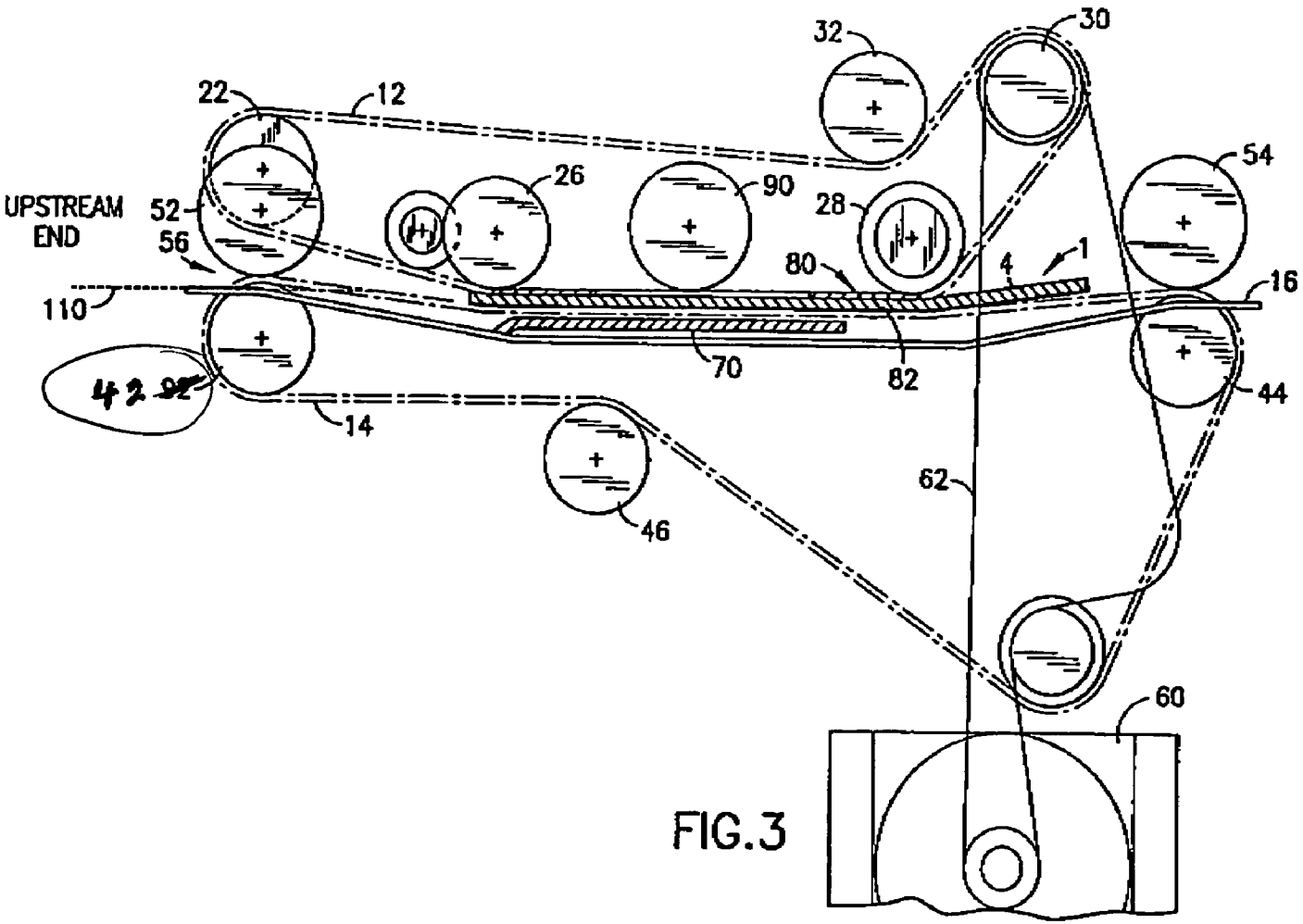
FIG. 3 is a diagrammatic representation illustrating the driving mechanism and the registration mechanism.

As shown in FIG. 2, the mailpiece 1 has an upper surface 4 to be printed by the print head 102 and an opposing lower surface 6 supported by the deck 16. The upper belt 12 loops around idler pulleys 22, 26, 28 and a drive pulley 30. The tension of the upper belt 12 is maintained by a tensioning idler 32. The lower belt 14 loops around idler pulleys 42, 44 and a drive pulley 50. The tension of the lower belt 14 is maintained by a tensioning idler 46. The upper belt 12 and the lower belt 14 form an ingest nip 40 to move the mailpiece 1 into the printing area 112 for printing. The upper belt 12 has a straight section 24 between the pulleys 26 and 28 running the length of the printing area 112 for holding the mailpiece 1 on both the upper surface 4 and the lower surface 6 in order to minimize skew of the mailpiece 1 as the mailpiece 1 moves through the printing area 112. The ingest nip 40 is in fact a soft nip, which is formed gradually by the wedge-shaped gap between the upper belt 12 and the lower belt 14 at the upstream end. The ingest nip 40 prevents the mailpiece 1 from slowing down as it would if the ingest nip were a hard nip. The plane joining the tangent of pulley 26 and the tangent of pulley 28 is substantially parallel to the print plane or the registration plane 110 (FIG. 3). Both the upper belt 12 and the lower belt 14 are driven by drive pulleys 30 and 50, respectively, in order to minimize shearing on the mailpiece 1. The motor 60 and the driving belt 62 that drive the drive pulleys 30 and 50 are illustrated in FIG. 3.

When the mailpiece 1 is ingested into the printing area 112 by the ingest nip 40, it has the tendency to bend downward. For a thin mailpiece, the straight section 24 of the upper belt 12 and the same section of the lower belt 14 can pinch the mailpiece tightly to keep it from moving away from print head 102 and the registration plane 110. However, if the mailpiece is thick, puffy or flexible, the straight section 24 of the upper belt 12 and the lower belt 14 may not be able to keep the upper surface 4 of the mailpiece 1 from moving downward and away from the registration plane 110. Thus, it is preferable to have a lifting mechanism 70 located below the registration plane 110 and underneath the printing area 112, as shown in FIG. 3, to push the mailpiece 1 towards the print head 102. Furthermore, a shield plate 80 having a lower surface 82 located substantially on the registration plane 110 is used to register the upper surface 4 of the mailpiece 1 precisely with respect to the print head 102. It is preferred that the lifting mechanism 70 has an opening (not shown) right under the print head 102 so that the print head 102 will not accidentally print on the lifting mechanism 70 when the mailpiece 1 is not present in the printing area 112. As shown in FIG. 3, a tensioning idler 52 can be used to form an input nip 56 with the input pulley 42 of the lower belt 14 in order to reduce skew when the mailpiece 1 is moved to the belts 12, 14 from the upstream end. The tensioning idler 52 may slow down the mailpiece 1 slightly when the mailpiece 1 hits the input nip 56. However, when the mailpiece 1 is engaged with the upper belt 12 and the lower belt 14, it moves along with the belts 12, 14. Furthermore, in order to ensure that the printing is in synchronism with the mailpiece 1 in that the drop ejection frequency of the print head 102 is matched to the movement of the mailpiece 1, it is possible to install an encoder 90 to be operatively engaged with the belts 12, 14 to measure their moving speed.

Figure 4:
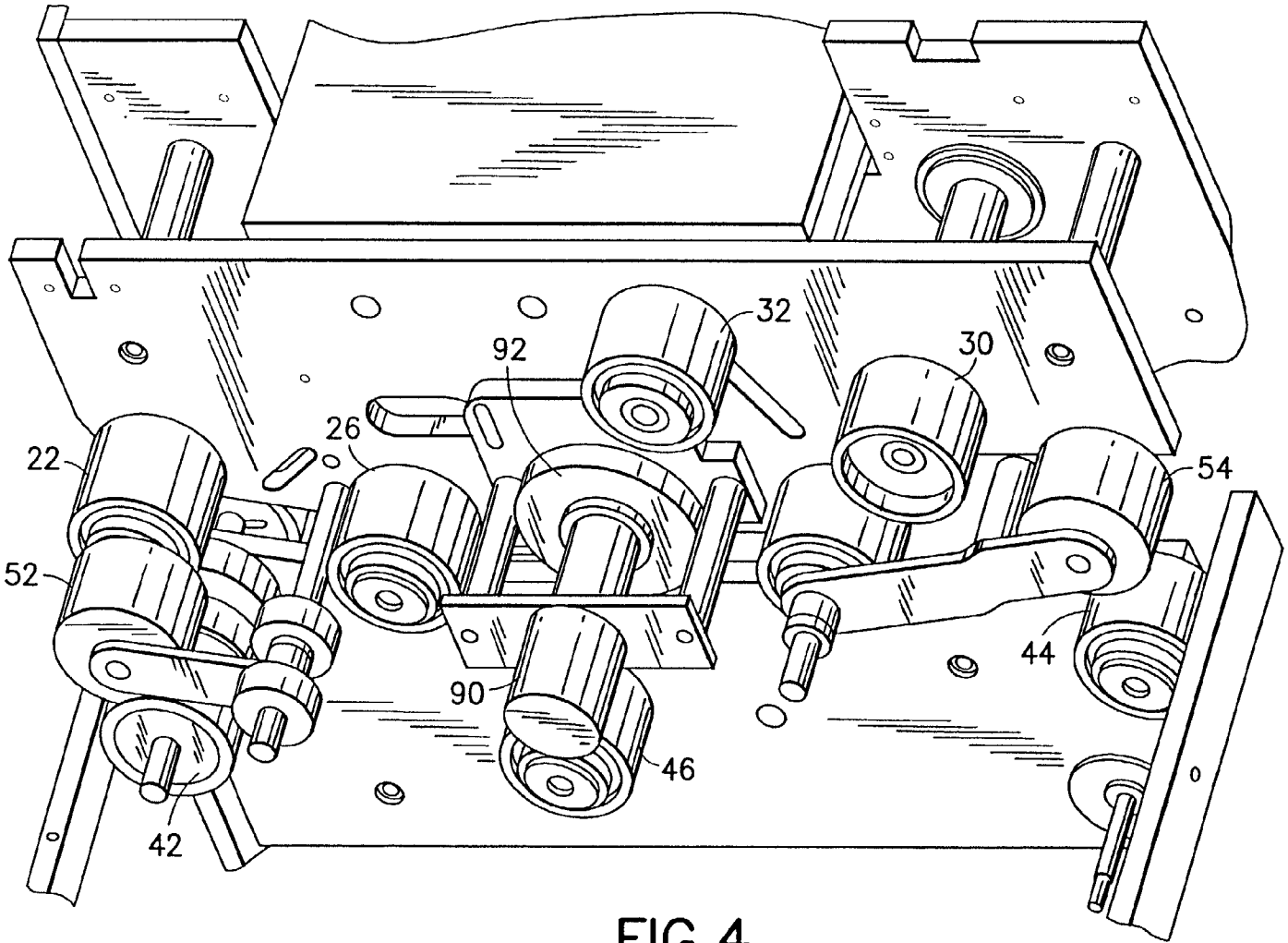
FIG. 4 is an isometric view illustrating the pulley, rollers, and the velocity encoder mechanism.

As shown in FIG. 4, the encoder 90 is connected to an encoder wheel 92, which is positioned between pulley 26 and pulley 28 of the upper belt 12 such that the encoder wheel 92 is rotated by the motion of the straight section 24 of the lower belt 12 (FIG. 2). The belts 12, 14 are not shown in FIG. 4.

In summary, double belts minimize skew of the mailpiece because both the upper and lower surfaces of the mailpiece are held by the belts when it moves through the printing area. Accurate registration of the upper surface of the mailpiece is achieved by the straight section of the upper belt, the shield plate and the lifting mechanism. The lifting mechanism can be loaded upward with springs. A velocity measurement mechanism, such as an optical encoder, is used to measure the speed of the upper belt and, therefore, the speed of the mailpiece in the printing area. The measured speed can be used to coordinate with the activation of the inkjet nozzles of the print head. It is also possible to install one or more encoders to make contact with the mailpiece itself in order to measure the moving speed of the mailpiece.

The printer as described in conjunction with FIGS. 1 to 4 is oriented in such a way that the registration plane 110 is substantially located on a horizontal plane. However, it should be understood by those skilled in the art that the registration plane can be located on an oblique plane or a vertical plane. Furthermore, the various pulleys in the double-belt transport system, according to present invention, can be substituted by rollers or other cylindrical elements capable of supporting the belts.

Figure 5A:
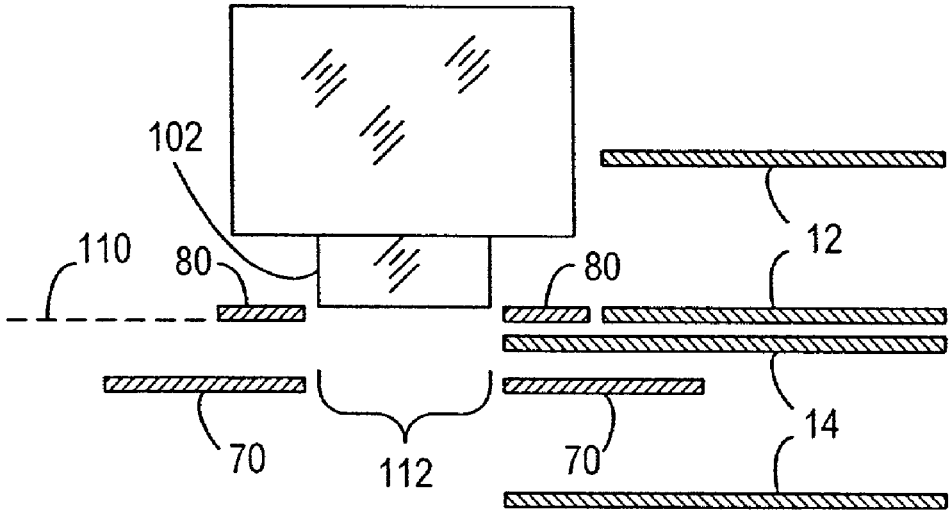
FIG. 5*a* is a diagrammatic representation illustrating a front cross sectional view of the preferred embodiment of the present invention looking in the direction of mail piece motion.
Figure 5B:
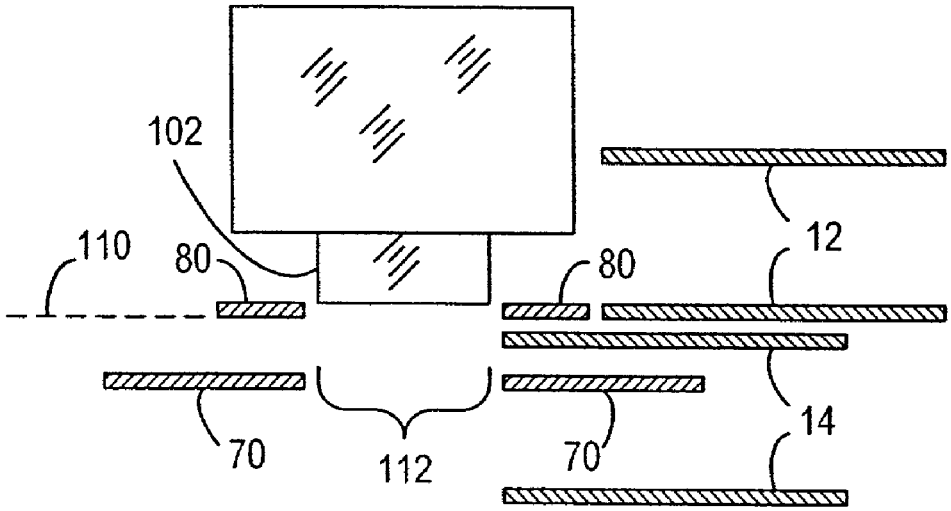
FIG. 5*b* is a diagrammatic representation illustrating another embodiment of the present invention looking in the direction of mail piece motion.
Figure 5C:
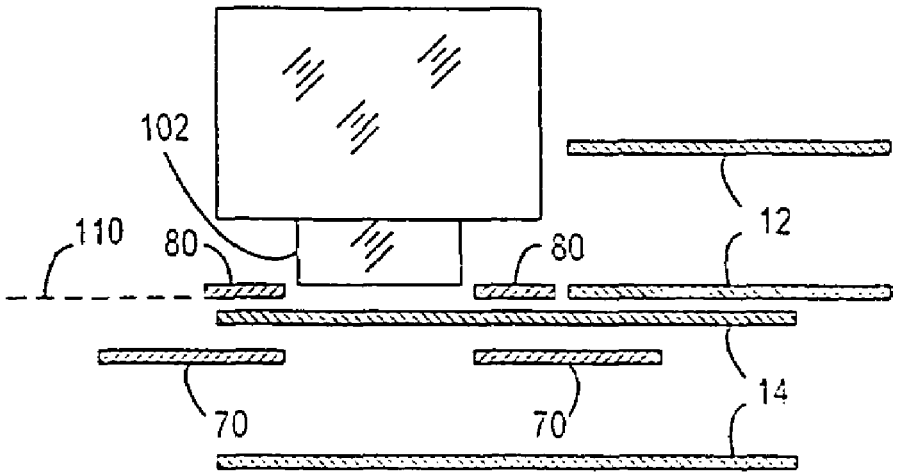
FIG. 5*c* is a diagrammatic representation illustrating yet another embodiment of the present invention looking in the direction of mail piece motion.
Figure 5D:
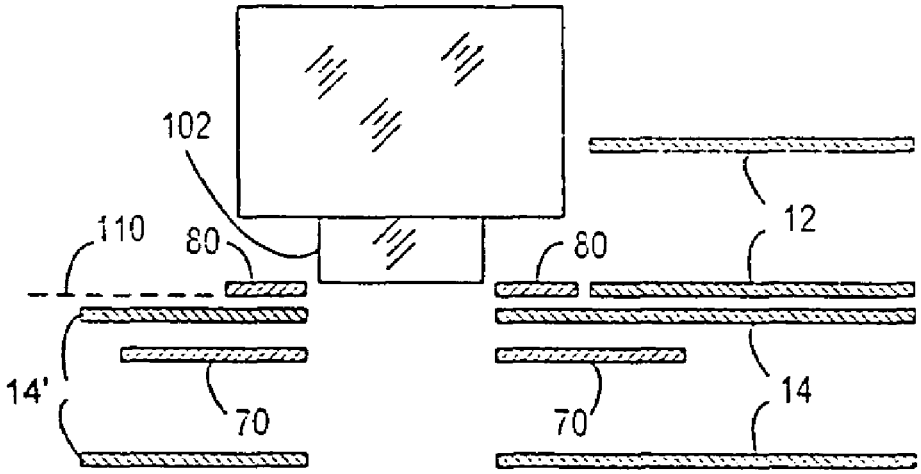
FIG. 5*d* is a diagrammatic representation illustrating a further embodiment of the present invention looking in the direction of mail piece motion.

Furthermore, the width and the location of the lower belt 14, in relation to the upper belt 12, can be changed based on the width of the mailpiece 1 (FIG. 1). It is preferable to have the inner edge of the lower belt 14 be positioned as close to the print area 112 under the print head 102 as possible, as shown in FIG. 5*a*. This position can help bias a narrow mailpiece against the shield plate 80. As shown in FIG. 5*a*, the lower belt 14 is slight wider than the upper belt 12. However, the lower belt 14 can be narrower than the upper belt 12, or both the lower belt 14 and the upper belt 12 are of the same width, as shown in FIG. 5*b*. Moreover, it is possible to extend the inner edge of the lower belt 14 to the other side of the print head 102, as shown in FIG. 5*c*. Alternatively, in addition to the lower belt 14, a second lower belt 14' can be used to advance the mail. However, the second lower belt 14' must be driven in synchronism with the lower belt 14 so as not to cause skew and lateral shift in the mail.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A printer having an upstream end and a downstream end for printing a mailpiece on an upper surface thereof, said printer comprising:

a print head located above a printing area; and a double belt transport system for moving the mailpiece from the upstream end into the printing area, wherein the mailpiece has a lower surface opposing the upper surface, and wherein the double belt transport system comprises:

an upper looping belt having a straight section covering the printing area, wherein the straight section defines a registration plane regarding the print head; and a lower looping belt that is wider than the upper belt to allow registration of the mail piece in the printing area, wherein the lower looping belt has an upper span that contacts the straight section of the upper belt forming a wedge-shaped gap resulting in a soft ingest nip so that the tension of the lower belt provides a normal force between the mailpiece and the upper belt for providing a friction force to move the mailpiece into the printing area for printing.

2. The printer of claim 1, further comprising a lifting mechanism located below the lower surface of the mailpiece for urging the mailpiece to move towards the straight section of the upper looping belt so that the upper surface of the mailpiece is located substantially in the registration plane when the mailpiece is moving into the printing area.

3. The printer of claim 2, further comprising a shield plate having a reference surface facing the lifting mechanism and located substantially in the registration plane in the printing area so as to allow the upper surface of the mailpiece to press against the reference surface for registration when the mailpiece is urged by the lifting mechanism to move towards the upper looping belt when the mailpiece is moving into the printing area.

4. The printer of claim 1, further comprising an upstream pulley and a downstream pulley defining a tangent plane therebetween, wherein the tangent plane is substantially parallel to the registration plane and wherein the upstream and downstream pulleys push against the upper looping belt to define the straight section of the upper looping belt.

5. The printer of claim 1, further comprising a deck having an upstream section located adjacent to the intake nip for supporting the mailpiece when the mailpiece moves towards the ingest nip.

6. The printer of claim 1, further comprising means for driving the upper looping belt and the lower looping belt for reducing shearing on the mailpiece.

7. The printer of claim 1, further comprising a velocity measurement mechanism operatively connected to at least one of the looping belts so as to match printing speech of the print head to moving speed of the mailpiece in the printing area.

8. The printer claimed in claim 1, further comprising:

a tensioning idler to maintain tension for the lower belt.

9. The printer claimed in claim 1, wherein the tower belt comprises: a first lower belt and a second lower belt located inbound of the printing area wherein the first and second lower belt support the mail piece on areas adjacent the print head.

* * * * *